US006315823B1

(12) United States Patent
Dolan

(10) Patent No.: US 6,315,823 B1
(45) Date of Patent: Nov. 13, 2001

(54) LITHIUM AND VANADIUM CONTAINING SEALING COMPOSITION AND PROCESS THEREWITH

(75) Inventor: Shawn E Dolan, Sterling Heights, MI (US)

(73) Assignee: Henkel Corporation, Gulph Mills, PA (US)

( * ) Notice: Subject to any disclaimer, the term of this patent is extended or adjusted under 35 U.S.C. 154(b) by 0 days.

(21) Appl. No.: 09/424,013

(22) PCT Filed: May 15, 1998

(86) PCT No.: PCT/US98/09374

§ 371 Date: Nov. 16, 1999

§ 102(e) Date: Nov. 16, 1999

(87) PCT Pub. No.: WO98/51841

PCT Pub. Date: Nov. 19, 1998

(51) Int. Cl.[7] ..... C23F 11/00; C23C 22/34; C23C 22/40; C23C 22/68

(52) U.S. Cl. ..... 106/14.21; 106/14.44; 148/243; 148/273; 427/327; 427/383.1; 427/419.1; 427/419.2

(58) Field of Search ..... 106/14.21, 14.44; 148/243, 273; 427/327, 383.1, 419.1, 419.2

(56) References Cited

U.S. PATENT DOCUMENTS

| | | | | |
|---|---|---|---|---|
| 3,945,899 | | 3/1976 | Nikaido et al. | 204/181 |
| 3,951,667 | * | 4/1976 | Kogure et al. | 106/1.12 |
| 4,828,615 | * | 5/1989 | Cape | 106/14.13 |
| 5,057,335 | * | 10/1991 | Hanagata et al. | 427/512 |
| 5,089,064 | | 2/1992 | Reghi | 148/247 |
| 5,268,042 | | 12/1993 | Carlson | 148/268 |
| 5,281,282 | | 1/1994 | Dolan et al. | 148/247 |
| 5,342,456 | | 8/1994 | Dolan | 148/247 |
| 5,356,490 | | 10/1994 | Dolan et al. | 148/247 |
| 5,411,606 | | 5/1995 | Schriever | 148/240 |
| 5,415,687 | | 5/1995 | Schriever | 106/1.27 |
| 5,427,632 | | 6/1995 | Dolan | 148/259 |
| 5,449,414 | | 9/1995 | Dolan | 148/247 |
| 5,449,415 | | 9/1995 | Dolan | 148/259 |
| 5,472,524 | | 12/1995 | Schriever | 148/273 |
| 5,487,949 | | 1/1996 | Schriever | 428/472.1 |
| 5,534,082 | | 7/1996 | Dollman et al. | 148/247 |
| 5,551,994 | | 9/1996 | Schriever | 148/273 |

FOREIGN PATENT DOCUMENTS

| | | |
|---|---|---|
| 2216925 | 10/1996 | (CA) . |
| 0488430 | 6/1992 | (EP) . |
| 2236021 | 1/1975 | (FR) . |
| 94 00619 | 1/1994 | (WO) . |
| 94 13273 | 11/1994 | (WO) . |
| 96 05335 | 2/1996 | (WO) . |
| 96 21753 | 7/1996 | (WO) . |
| 96 29448 | 9/1996 | (WO) . |

* cited by examiner

*Primary Examiner*—Anthony Green
(74) *Attorney, Agent, or Firm*—Wayne C. Jaeschke; Stephen D. Harper; Norvell E. Wisdom, Jr.

(57) ABSTRACT

The corrosion resistance of an article having a surface with a primary inorganic coating, such as a conversion coating, over a metal substrate can be improved by treatment of the primary coating with an aqueous liquid sealing composition comprising lithium cations and vanadate anions. This treatment is particularly advantageous for primary coatings formed on aluminum alloys by treating them with a conversion coating forming aqueous composition made by reacting cobalt(II) cations, acetate ions, hydroxyalkyl amines, and peroxides in aqueous solution.

20 Claims, No Drawings

LITHIUM AND VANADIUM CONTAINING SEALING COMPOSITION AND PROCESS THEREWITH

FIELD OF THE INVENTION

This invention relates to compositions and processes for improving the protection against corrosion that is provided by a pre-existing primary coating over a metal surface, particularly a zinc, aluminum and/or zinc and/or aluminum alloy, more particularly an aluminum and/or aluminum alloy, surface.

BACKGROUND OF THE INVENTION AND RELATED ART

A process of this type is called a "sealing" process because, in some instances, the effect of the process has been theoretically ascribed to sealing pores that exist in the primary coating. The evidence for such pores is generally regarded as very strong for coatings formed by anodizing aluminum, for example, but the term "sealing" is now applied to any liquid composition that can be contact with a pre-existing coating, particularly a conversion coating, over a metal surface in order to improve the corrosion resistance of the object including the metal surface and all of its protective coating(s) and to any process that thus improves the corrosion resistance, irrespective of whether any pores in the primary coating are actually sealed or even existed at the time of treatment. Alternative names for what is herein called "sealing" in this sense include "passivating", "final rinsing", "post-rinsing", and the like. A sealing treatment according to this invention is especially advantageous for surfaces that are not intended to receive any further protective organic based coating such as paint or the like, but is also useful for substrates that are to be further protected in this way.

Numerous sealing compositions for a variety of primary coatings are known in the prior art, but, particularly for aluminum substrates that are not to receive any substantial protective coating of paint or a similar material containing an organic binder, still further improvements in corrosion resistance are desirable. Accordingly, a major object of this invention is to provide sealing compositions and processes that, in combination with known primary coatings, produce improved corrosion resistance, especially in the absence of organic protective coatings. Other alternative or concurrent objects are to minimize adverse environmental impact compared with related previously used sealers, which often contained hexavalent chromium or other materials capable of readily damaging the environment, and to provide more economical treatments without diminishing the corrosion protection achieved. Other objects will be apparent from the description below.

Except in the claims and the operating examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred, however. Also, throughout the description, unless expressly stated to the contrary: percent, "parts of", and ratio values are by weight or mass; the term "polymer" includes "oligomer", "copolymer", "terpolymer" and the like; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description or of generation in situ within the composition by chemical reaction(s) noted in the specification between one or more newly added constituents and one or more constituents already present in the composition when the other constituents are added, and does not necessarily preclude unspecified chemical interactions among the constituents of a mixture once mixed; specification of constituents in ionic form additionally implies the presence of sufficient counterions to produce electrical neutrality for the composition as a whole and for any substance added to the composition; any counterions thus implicitly specified preferably are selected from among other constituents explicitly specified in ionic form, to the extent possible; otherwise such counterions may be freely selected, except for avoiding counterions that act adversely to an object of the invention; the word "mole" means "gram mole", and the word itself and all of its grammatical variations may be used for any chemical species defined by all of the types and numbers of atoms present in it, irrespective of whether the species is ionic, neutral, unstable, hypothetical, or in fact a stable neutral substance with well defined molecules; and the terms "solution", "soluble", "homogeneous", and the like are to be understood as including not only true equilibrium solutions or homogeneity but also dispersions that show no visually detectable tendency toward phase separation over a period of observation of at least 100, or preferably at least 1000, hours during which the material is mechanically undisturbed and the temperature of the material is maintained within the range of 18–25° C.

BRIEF SUMMARY OF THE INVENTION

A sealing composition according to this invention is a homogeneous liquid composition that comprises, preferably consists essentially of, or more preferably consists of, water, lithium cations, and vanadate anions, particularly decavanadate anions, which should be understood hereinafter to include not only ions with the chemical formula $V_{10}O_{28}^{-6}$ which are present in decavanadate salts but also protonated derivatives thereof having the general formula $V_{10}O_{(28-i)}(OH)_i^{-(6-i)}$, where i represents an integer from one to four, which are believed to be the predominant species present in aqueous solutions with a pH from 2 to 6. Cf. F. A. Cotton and G. Wilkinson, *Advanced Inorganic Chemistry,* 4th Ed., (John Wiley & Sons, New York, 1980), p. 712. Optionally, a sealing composition according to the invention may also contain one or more of surfactants, pH adjusting components, and fluoride ions. This sealing composition, either as such or after dilution with water, is suitable for sealing any primary coating layer containing metal and oxygen atoms, especially cobalt and aluminum oxides. If immediately suitable for use, a composition according to the invention may be called a "working composition"; if preferably used only after dilution with water, a composition according to the invention may be called a "concentrate", "concentrated composition", or "concentrate composition", which three terms are considered interchangeable herein. Many compositions according to the invention, of course, may be suitable for use either as such or after dilution with water and then may be called either working or concentrated compositions.

A process according to the invention comprises at a minimum a step of bringing a composition according to the invention as defined herein into contact with a primary coating layer for a sufficient time at a sufficient temperature that, after discontinuance of contact and drying, optionally with intermediate rinsing or other treatment with water of the primary coating layer after its formation but before contact with the sealing composition, additional rinsing after contact with the sealing composition, and/or additional coating treatments after drying, the object treated has measurably better corrosion resistance in at least one accelerated corrosion test or at least one type of actual use than does an otherwise identical object that is identically treated, except that deionized or at least equally well purified water is substituted for the sealing composition according to the invention used in a process according to the invention. Additional process steps, including those that are conventional in themselves, may also be part of a process according to the invention. It is preferred that none of these other steps include contacting the surfaces with any composition that contains more than, with increasing preference in the order given, 1.0, 0.35, 0.10, 0.08, 0.04, 0.02, 0.01, 0.003, 0.001, or 0.0002% of hexavalent chromium, except that a final protective coating system including an organic binder, more particularly those including primer coat, may include hexavalent chromium as a constituent. Any such hexavalent chromium in the protective coating is generally adequately confined by the organic binder, so as to avoid adverse environmental impact. Objects treated by a process according to the invention are also within the scope of the invention.

BRIEF DESCRIPTION OF THE SEVERAL VIEWS OF THE DRAWING

Not applicable.

DETAILED DESCRIPTION OF THE INVENTION

For a variety of reasons, it is preferred that compositions according to the invention as defined above should be substantially free from many ingredients used in compositions for similar purposes in the prior art. Specifically, it is increasingly preferred in the order given, independently for each preferably minimized component listed below, that sealing compositions according to this invention, when directly contacted with a primary coating over metal in a process according to this invention, preferably contain, with increasing preference in the order given, no more than 1.0, 0.35, 0.10, 0.08, 0.04, 0.02, 0.01, 0.001, or 0.0002, percent of each of the following constituents: hexavalent chromium, cyanide, nitrite ions, and any coordinate complexing agents that stabilize cobalt(II) more than cobalt(III) cations. Independently, sealing compositions according to the invention preferably contain, with increasing preference in the order given, not more than 0.033, 0.030, 0.027, 0.024, 0.021, 0.018, 0.015, 0.012, 0.009, 0.006, 0.003, 0.001, or 0.0003 moles of tungsten in any anionic form per kilogram of total composition. (The concentration unit of moles of constituent per kilogram of total composition may be used hereinafter for any other constituent as well as for tungsten in anionic form and is hereinafter usually abbreviated as "M/kg".)

The lithium ions needed in a composition according to the invention may be supplied by any sufficiently soluble lithium salt, hydroxide, or oxide, or even by reaction with lithium metal, although the latter is rarely preferred because of the expense and safety precautions that are required. Generally for economic reasons the least expensive source will be selected, and in the U.S. at least, this usually means lithium hydroxide. Whatever the source, the concentration of dissolved lithium cations in a working composition according to the invention preferably is at least, with increasing preference in the order given, 0.0040, 0.0070, 0.010, 0.020, 0.030, 0.040, 0.050, 0.060, 0.065, 0.070, or 0.072 M/kg and independently preferably is not more than, with increasing preference in the order given, 0.75, 0.50, 0.30, 0.20, 0.130, 0.115, 0.105, 0.095, 0.085, 0.080, 0.077, or 0.074 M/kg.

Vanadates of any degree of aggregation may be used to supply the dissolved vanadium atoms required in a composition according to the invention, but decavanadates are most preferred; sodium ammonium decavanadate with the chemical formula $Na_2(NH_4)_4V_{10}O_{28}$ is currently most particularly preferred, because it is the least costly commercially available source of decavanadate ions. If other vanadates are used, the counterions are preferably selected from the group consisting of alkali metal and ammonium cations, because most other vanadates are insufficiently soluble in water. The concentration of vanadium atoms present in vanadate ions is a sealing composition according to this invention preferably is at least, with increasing preference in the order given, 0.00050, 0.0010, 0.0020, 0.0030, 0.0040, 0.0050, 0.0060, 0.0070, 0.0080, 0.0085, 0.0090, or 0.0092 M/kg and independently preferably is not more than, with increasing preference in the order given, 0.15, 0.10, 0.080, 0.060, 0.040, 0.030, 0.025, 0.020, 0.017, 0.014, 0.011, or 0.0095 M/kg. Furthermore, independently of their actual concentrations, the ratio of the concentration of vanadium atoms in M/kg to the concentration of lithium cations in M/kg in a composition according to the invention preferably is at least, with increasing preference in the order given, 0.010:1.0, 0.030:1.0, 0.050:1.0, 0.070:1.0, 0.080:1.0, 0.090:1.0, 0.100:1.0, 0.110:1.0, 0.120:1.0, or 0.125:1.0 and independently preferably is not more than, with increasing preference in the order given, 1.0:1.0, 0.8:1.0, 0.60:1.0, 0.50:1.0, 0.40:1.0, 0.30:1.0, 0.25:1.0, 0.20:1.0, 0.18:1.0, 0.16:1.0, 0.140:1.0, or 0.130:1.0.

Normally, a sealing composition according to the invention preferably contains anions including fluorine atoms, which anions may be simple fluoride anions with the chemical formula $F^-$, acid fluoride ions with the chemical formula $HF_2^-$, fluoroborate ions with the formula $BF_4^-$, fluorometallate ions conforming to the general formula $MF_6^{-2}$, where M represents Si, Ti, Zr, Sn, Sb, or Hf, or fluorometallate ions conforming to the general formula $M'F_6^{-3}$, where M' represents Al or Fe. Simple fluoride ions are generally preferred for economy if no other reason. The anions including fluorine atoms can be derived from any suitable salt or acid as known to those skilled in the art. As already noted above, the cations in any salts used normally should be selected from alkali metal and ammonium cations, to minimize the danger of precipitating much of the vanadate content. When present, the concentration of fluorine atoms in anionic form in a working composition according to the invention preferably is at least 0.005, 0.007, 0.009, 0.012, 0.016, 0.020, 0.030, 0.040, 0.045, 0.050, or 0.054 M/kg and independently preferably is not more than, with increasing preference in the order given, 0.50, 0.40, 0.30, 0.20, 0.10, 0.080, 0.070, 0.065, 0.060, or 0.056 M/kg. Independently, the ratio of the concentration in M/kg of fluorine atoms in anionic form in a composition according to the invention to the concentration in M/kg of lithium cations in the same composition preferably is at least, with increasing preference in the order given, 0.02:1.0, 0.05:1.0, 0.10:1.0, 0.20:1.0, 0.30:1.0, 0.40:1.0, 0.50:1.0, 0.55:1.0, 0.60:1.0, 0.65:1.0, 0.70:1.0, or 0.74:1.0 and independently preferably is not more than, with increasing preference in the order given, 10:1.0, 5:1.0, 3.0:1.0, 2.0:1.0, 1.7:1.0, 1.5:1.0, 1.3:1.0, 1.1:1.0, 0.97:1.0, 0.93:1.0, 0.89:1.0, 0.85:1.0, 0.81:1.0, or 0.76:1.0.

Inclusion of a surfactant in a composition according to the invention is normally preferred, in order to improve the ability of the composition to wet the primary coating surfaces contacted with it in a uniform manner. Any surfactant that achieves this purpose may be used, and surfactant may also be omitted altogether, but a cationic surfactant, particularly a predominantly tertiary amine surfactant the molecules of which conform to the following general formula:

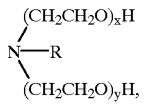

where each of x and y in an individual molecule represents a non-negative integer and R represents a hydophobe group, is preferred. In a surfactant in which the molecules conform to this formula, the average value for the sum of x and y preferably is at least, with increasing preference in the order given, 2, 5, 7, 8, 10, 11 or 12 and independently preferably is not more than, with increasing preference in the order given, 27, 22, 17, 15, 14, or 12; and, independently for each preference stated: at least, with increasing preference in the order given, 50, 60, 70, 80, 83, 86, or 89% of the R moieties are saturated alkyl groups; at least 50, 60, 70, 80, 85, 90, or 95% of the R moieties are straight chain alkyl groups; and the average number of carbon atoms per R moiety is at least, with increasing preference in the order given, 8.0, 9.0, 10.0, 11.0, or 12.0 and independently preferably is not more than, with increasing preference in the order given, 22, 20, 18.0, 17.0, 16.0, 15.0, 14.0, or 13.0. A mixture of hydrophobe moieties R derived from the fatty acids produced by saponification of natural coconut oil is most preferred. If a surfactant is used, its concentration in a composition according to the invention preferably is at least, with increasing preference in the order given, 0.00010, 0.00030, 0.00050, 0.00070, 0.00080, 0.00090, 0.0010, or 0.0012 parts of the surfactant per thousand parts of the total composition (a concentration unit that may be used hereinafter for any other constituent as well as for surfactant and is hereinafter usually abbreviated as "ppt") and independently preferably is not more than, with increasing preference in the order given, 0.010, 0.008, 0.006, 0.004, 0.0030, 0.0025, 0.0020, 0.0017, or 0.0014 ppt.

The components of a composition according to the invention as specified above are capable of nourishing some microbes that may be introduced into them from an ambient atmosphere. In order to prevent any difficulties from such a source, an optional preservative may be incorporated into a composition according to this invention. Any preservative that does not frustrate the object(s) of the invention may be used, in a quantity as generally known in the art. Preservatives for use in this invention preferably are organic molecules containing at least one of: isothiazolin-3-one moieties; halogen, preferably bromine atoms, more preferably at least two per molecule; and cyano moieties, preferably at least two per molecule. Preservatives that have been found to be particularly suitable include those sold under the trademark KATHON™ by Rohm and Haas Co., for example KATHON™ 886 MW, which is reported by its supplier to contain 10–12% of 5-chloro-2-methyl-isothiazolin-3-one and 3–5% of 2-methyl-isothiazolin-3-one as its preservative active ingredients along with 14–18% of magnesium nitrate and 8–10% of magnesium chloride, all in water solution with water as the balance, and those sold under the trademark TEKTAMER™ by Calgon Corp., for example TEKTAMER™ 38LV, which is reported by its supplier to consist of 25% of 1,2-dibromo-2,4-dicyanobutane dispersed in water.

In order to avoid the cost of shipping large quantities of water, it is often preferred in practice to formulate a sealing composition according to the invention as a concentrated rather than a working composition. In such an instance, the concentrated composition preferably contains the same components as are noted above for working compositions, but in a concentration for each ingredient except water that is at least, with increasing preference in the order given, 2, 4, 6, 8, 10, 20, 30, 40, or 50 times higher than the concentration specified above for a working composition.

The pH value of a working sealing composition according to the invention preferably is at least, with increasing preference in the order given, 2.0, 3.0, 4.0, 4.5, 4.8, 5.1, 5.3, or 5.5 and independently preferably is not more than, with increasing preference in the order given, 8.0, 7.5, 7.0, 6.7, 6.4, 6.2, or 6.0. If the pH is too high, the underlying metal may be attacked, while if the pH is too low, the primary coating may be dissolved instead of sealed. If lithium hydroxide is used as the major source of lithium and other necessary and optional ingredients as described above are present in preferred amounts, an acidifying pH adjusting component will normally be needed to bring the pH into at least its most preferred range. In order to provide a buffering effect within a preferred pH range, a weakly ionizing acid is generally preferred, and acetic acid, which is economical and does not pose any risk of precipitating other normal ingredients of a sealing composition according to this invention, has been found highly suitable.

The temperature of a sealing composition according to the invention, during contact with the previously primarily treated and optionally intermediately treated metal substrate as described briefly above and in more detail below preferably is, with increasing preference in the order given, at least 15, 20, 22.0, 23.0, 24.0, 25.0, 26.0 or 26.5° C. and independently, primarily for reasons of economy, preferably is, with increasing preference in the order given, not more than 90, 80, 70, 60, 50, 45, 40, 35, 30, or 28° C. At 26.7° C., the time of contact between such a sealing composition according to this invention and the previously primarily treated and optionally intermediately treated metal substrate preferably is, with increasing preference in the order given, not less than 0.5, 1.0, 2.0, 2.5, 3.0, 3.5, 4.0, 4.3, 4.6, or 4.9 min and independently preferably is, with increasing preference in the order given, primarily for reasons of economy, not greater than 60, 30, 15, 12, 10, 8, 7.0, 6.5, 6.0, 5.7, 5.4, or 5.1 min. For other temperatures during treatment with a sealing composition of this type, shorter times are preferred at higher temperatures and longer times at lower temperatures.

After a sealing process according to the invention, the sealed surfaces preferably are again rinsed with water, preferably deionized or at least equally purified water, before drying or being allowed to dry. If heat is used to accelerate drying, the temperature of the metal during drying preferably does not exceed, with increasing preference in the order given, 100, 85, 75, 66, or 60°C., in order to avoid damage to the protective quality of the coating formed by a process according to the invention A process according to the invention most preferably is applied to a surface on which the pre-existing primary treatment has been formed by contacting a metal surface, preferably a cleaned and deoxidized aluminum alloy surface with a primary treatment composition made by reaction in an aqueous solution comprising, preferably consisting essentially of, or more preferably consisting of, water and the following dissolved components:

(A) cobalt(II) cations;

(B) carboxylate anions;

(C) chemical species, exclusive of carboxylate anions, that form more stable coordination bonds with cobalt (III) cations than with cobalt(II) cations; and (D) an oxidizing agent; and, optionally, one or more of the following components:

(E) nitrate ions;

(F) a component selected from the group consisting of alkali metal and alkaline earth metal cations; and (G) fluoride and complex fluoride anions, wherein the ratio of the number of moles of component (B) to the number of moles of component (A) in the aqueous solution prior to reaction is from 0.10 to 6.8.

Contact of an "active" metal substrate with such a primary treatment composition results in formation on the surface of the metal substrate of an adherent conversion coating containing at least cobalt and oxygen atoms and also some metal atoms from the substrate treated. (Any metal that reacts in this way is considered to be an "active metal" within the meaning of that term hereinafter.)

The concentration of component (A) reacted preferably is such that, in a preferred primary composition used to form a primary coating before a sealing process according to the invention, the concentration of cobalt atoms is, with increasing preference in the order given, not less than 0.001, 0.002, 0.004, 0.008, 0.016, 0.032, 0.040, 0.045, 0.050, 0.055, 0.060, 0.063, 0.066, 0.069, 0.072, 0.074, or 0.076 M and independently preferably is, with increasing preference in the order given, not more than 0.8, 0.6, 0.4, 0.2, 0.17, 0.14, 0.11, 0.090, 0.085, 0.080, or 0.078 M. The particular counterion(s) in the salt(s) in the form of which the cobalt(II) cations usually are added to the aqueous solution in which they are reacted are not narrowly restricted, but any counterions that bind so stably to cobalt(II) that they prevent it from being oxidized to cobalt(III) during reaction with the other components should be avoided. However, in order to minimize the prospects of unwanted interference with the desired reactions, the counterions for cobalt when added to the aqueous solution in which it is reacted are preferably selected from the group consisting of nitrate ions, which have relatively weak complex forming tendencies, and carboxylate ions that are part of component (B).

Component (B) is preferably selected from the anions of unsubstituted carboxylic acids containing from 1 to 6 carbon atoms, or more preferably, with increasing preference in the order given, not more than 5, 4, 3, or 2 carbon atoms, per molecule. Acetate ions are most preferred, largely because they are less expensive than most other carboxylates. Independently, the ratio of the number of moles of component (B) to the number of moles of component (A) in solution before any reaction between them preferably is, with increasing preference in the order given, at least 0.1:1.0, 0.2:1.0, 0.4:1.0, 0.8:1.0, 1.2:1.0, 1.5:1.0, 1.8:1.0, 2.0:1.0, 2.2:1.0, 2.3:1.0, 2.4:1.0, 2.5:1.0, or 2.6:1.0 and independently preferably is, with increasing preference in the order given, not greater than 6.5:1.0, 6.0:1.0, 5.5:1.0, 5.0:1.0, 4.5:1.0, 4.0:1.0, 3.7:1.0, 3.4:1.0, 3.1:1.0, 3.0:1.0, 2.9:1.0, 2.8:1.0, or 2.7:1.0. The most preferred concentrations of carboxylate ions are thus greater than can be supplied by cobalt(II) carboxylates themselves, and for the alternative cations that serve as counterions for this "excess" carboxylate, alkaline earth metal cations, particularly magnesium and calcium, most preferably magnesium, are preferred over alkali metal cations, although the latter can also be used. The use of carboxylic acids to supply the needed amounts of carboxylate ions, although also possible within the scope of the invention, is not preferred, because such use tends to depress the pH value of a composition according to the invention below the most preferred values as set forth below.

Component (C) preferably is selected from organic compounds containing at least one nitrogen atom with an unshared electron pair per molecule of compound. Hydroxyalkyl amines, most particularly triethanol amine, are the most preferred class of materials for component (C). Independently, the ratio of molar concentration of nitrogen atoms each bearing an unshared electron pair to the molar concentration of component (A) present in solution before any reaction between them preferably is, with increasing preference in the order given, not less than 0.03:1.0, 0.06:1.0, 0.13:1.0, 0.20:1.0, 0.24:1.0, 0.26:1.0, 0.28:1.0, 0.30:1.0, 0.32:1.0, 0.34:1.0, 0.35:1.0, or 0.36:1.0 and independently preferably is, with increasing preference in the order given, not more than 2.0:1.0, 1.75:1.0, 1.50:1.0, 1.25:1.0, 1.00:1.0, 0.75:1.0, 0.60:1.0, 0.50:1.0, 0.45:1.0, 0.41:1.0, 0.39:1.0, or 0.38:1.0.

The amount and oxidizing strength of component (D) used should be sufficient to cause a change in the color and/or an increase in the ultraviolet adsorption at some wavelength in the range of 160–450 nanometers (hereinafter abbreviated "nm") of a precursor solution containing only water, components (A), (B), and (C), and any possible reaction products among these constituents, after component (D) is added to the precursor mixture solution. Ordinary ambient air or any other source of gaseous oxygen is suitable as the oxidizing agent, but for speed of preparation, convenience, and facile control of the process, soluble compounds including a peroxide and/or superoxide moiety are preferred, with peroxide more preferred and hydrogen peroxide most preferred (because it is normally the least expensive peroxide commercially available), as at least part of component (D). The ratio of the molar concentration of peroxide moieties present in the solution before reaction to the molar concentration of cobalt atoms present in the solution preferably is, with increasing preference in the order given, at least 0.05:1.0, 0.10:1.0, 0.20:1.0, 0.30:1.0, 0.40:1.0, 0.45:1.0, 0.50:1.0, 0.55:1.0, 0.60:1.0, 0.65:1.0, 0.68:1.0, 0.71:1.0, or 0.73:1.0 and independently preferably is, with increasing preference in the order given, not more than 10:1.0, 7:1.0, 5:1.0, 3:1.0, 2:1.0, 1.5:1.0, 1.0:1.0, 0.95:1.0, 0.90:1.0, 0.85:1.0, 0.80:1.0, 0.77:1.0, or 0.74:1.0.

Even when peroxide is used in preparing a preferred primary composition used to form a primary coating before a sealing process according to the invention, it is preferable to keep the primary composition well aerated during use, by employing (i) a spray to contact the solution with the metal to be treated, (ii) a separate spray treater for aeration purposes in a process line through which the preferred primary composition used to form a primary coating before a sealing process according to the invention is circulated during use, and/or (iii) sparging with air and/or oxygen gas in a container for the primary composition in such a process line, which container conveniently may be the immersion tank if immersion processing is used.

The presence, particularly from the beginning of reaction, of nitrate ions in the mixture reacted to make a preferred primary composition used to form a primary coating before a sealing process according to this invention is generally preferred, because it has been observed that more nearly uniform primary coatings on aluminum are achieved in such cases. Accordingly, the ratio of the molar concentration of nitrate ions before reaction to the molar concentration of cobalt atoms in the aqueous compositions reacted to make preferred compositions used to form a primary coating before a sealing process according to this invention preferably is, with increasing preference in the order given, not less than 0.05:1.0, 0.1:1.0, 0.2:1.0, 0.4:1.0, 0.6:1.0, 0.8:1.0, 1.0:1.0, 1.2:1.0, 1.4:1.0, 1.6:1.0, 1.8:1.0, 1.9:1.0, or 1.95:1.0 and independently preferably is, with increasing preference in the order given, not more than 20:1.0, 15:1.0, 10:1.0, 5:1.0, 4:1.0, 3.5:1.0, 3.0:1.0, 2.8:1.0, 2.6:1.0, 2.4:1.0, 2.2:1.0, 2.1:1.0, or 2.05:1.0.

The pH value of working preferred primary compositions used to form a primary coating before a sealing process according to this invention preferably is, with increasing preference in the order given, at least 3, 4, 4.5, 5.0, 5.5, 6.0, 6.2, 6.3, 6.4, 6.5, 6.6, 6.7, or 6.8 and independently preferably is, with increasing preference in the order given, not more than 10, 9, 8.5, 8.2, 8.0, 7.9, 7.8, 7.7, 7.6, 7.5, 7.4, 7.3, or 7.2. Values of pH within these preferred ranges will generally result from using the preferred components noted above in preparing the preferred compositions used to form a primary coating before a sealing process according to the invention, but the pH value may be adjusted as needed by minor additions of other acidic or basic components as generally known in the art. Values of pH higher than the preferred upper limits given above often result in rapid formation of cobalt containing precipitates, thereby making the compositions unfit for their intended use, while pH values below the preferred lower limits given above are likely to destabilize cobalt(III) sufficiently to impair the desired functioning of the compositions.

In preparing the preferred compositions used to form a primary coating before a sealing process according to the invention, components (A) and (B) are preferably mixed together in aqueous solution at first in the absence of other constituents, except for the counterions of components (A) and (B) and optional component (E) if used, and component (C) then added to this mixture. Only after components (A), (B), and (C) have been well mixed in solution should any of component (D) (except for the air in equilibrium with the aqueous solution) be added. Although the temperature during mixing is not narrowly restricted, so that any temperature between the freezing and boiling points of the solution may be used, all these additions are most preferably made while the solution is at approximately normal ambient temperature, i.e., 20–25° C.

Ordinarily, before treatment to form a primary coating to be sealed according to this invention, a metal substrate surface preferably should be cleaned, and if the substrate is one of the metals such as aluminum and magnesium that are prone to spontaneous formation of thick oxide layers on their surfaces, it should also be deoxidized by some process known per se in the prior art or by some other suitable process. Preferred deoxidizing processes are described in the working examples below.

Preferred primary compositions used to form a primary coating before a sealing process according to the invention can be used over a substantial range of temperatures, with formation of protective coatings generally at least slightly faster at higher temperatures within the range. As a generalization, the temperature during a primary coating forming process when using one of the above noted preferred compositions preferably is, with increasing preference in the order given, at least 20, 25, 28, 30, 32, 34, 35, 36, or 37° C. and, if rapid formation of an adequate coating is more important than maximum possible corrosion resistance, more preferably is, with increasing preference in the order given, at least 40, 43, 45, 47, or 49° C. Independently, as a generalization, the temperature during a primary coating forming process when using one of the above noted preferred compositions preferably is, with increasing preference in the order given, not more than 90, 85, 80, 75, 72, 69, 67, 65, 63, 62, 61, or 60° C.; and, if maximum possible corrosion resistance is desired, particularly when the metal substrates treated according to this invention are to be used without any painting or similar organic based protective coating, more preferably is, with increasing preference in the order given, not more than 55, 50, 45, 40, 39, or 38° C.

Contact between a preferred primary composition used to form a primary coating before a sealing process according to the invention and the metal substrate being treated in a primary coating forming process can be achieved by any convenient method or combination of methods. Immersion and spraying, for example, are both capable of giving completely satisfactory results. Generally, spraying achieves desired coating weights somewhat more rapidly than immersion, perhaps because of more effective mixing of the portion of the liquid primary composition in close proximity to the treated surface with the bulk of the liquid primary composition and/or the greater opportunity that is provided by spraying for atmospheric oxygen to participate in the coating forming reaction. Whatever the actual reason, at 60° C. for spraying the contact time preferably is, with increasing preference in the order given, not less than 5, 10, 20, 30, 40, 50, 60, 65, 70, 75, 80, 85, or 90 seconds (hereinafter usually abbreviated "sec") and independently preferably is, with increasing preference in the order given, not more than 30, 15 12, 10, 8, 6, 5, 4, 3, 2.5, 2.2, 2.0, 1.8, 1.7, 1.6, or 1.55 minutes (hereinafter usually abbreviated "min"). For immersion at 60° C., the contact time preferably is, with increasing preference in the order given, at least 0.2, 0.5, 0.8, 1.0, 1.5, 2.0, 2.5, 2.8, 3.2, 3.6, or 3.9 min and independently preferably is, with increasing preference in the order given, not more than 30, 25, 20, 15, 12, 9, 8, 7, 6, or 5 min. For immersion at 38° C., the contact time preferably is, with increasing preference in the order given, at least 2, 5, 8, 10, 11, 12, 13, or 14 min and independently preferably is, with increasing preference in the order given, primarily for reasons of economy, not more than 60, 40, 30, 25, 20, 18, 17, or 16 min. At other temperatures, the contact times generally preferably should be greater at lower temperatures and may be shorter at higher temperatures.

After formation of a primary coating, the treated metal surface, now bearing a primary coating, preferably is rinsed with water before being dried or allowed to dry. In many instances, including those in which the primary coating contains cobalt, oxygen, and aluminum, even if the primary coating is not formed by use of a preferable composition as described above, but may be formed, for example, according to the teachings of WO94/00619, it is advantageous, in addition to or in lieu of ordinary rinsing that would normally be completed in a minute or less, to maintain contact between water and the surface treated with the primary treatment as described above for a more extended period of time. The total time for this intermediate treatment preferably is, with increasing preference in the order given, at least 1.0, 2.0, 3.0, 3.5, 4.0, 4.3, 4.6, or 4.9 min and independently preferably is, with increasing preference in the order given, primarily for reasons of economy, not more than 60, 30, 20, 10, 8, 7.0, 6.5, 6.0, 5.7, 5.4, or 5.1 min. Ordinarily, this intermediate treatment is preferably accomplished by immersion, because spraying for such relatively long times is likely to result in larger volumes of waste water and/or loss of water by evaporation. Ordinarily, a single immersion for the entire time desired is satisfactory and is preferred because it is more economical, but the total period of immersion can also be achieved by two or more immersions with an interval of removal of the treated substrate from contact with water between each immersion and the immediately successive immersion if any. The use of an intermediate treatment is particularly preferred if it is to be followed by a sealing treatment containing vanadium along with more than preferred amounts of anionic tungsten.

As already noted, purified water is normally preferred for this intermediate treatment, but an oxidizing agent such as nitrite ions, conveniently added in the form of sodium nitrite, may be included along with the water if desired. The temperature is not narrowly restricted, but ordinarily ambient or slightly higher than ambient temperatures in the range from 20 to 30, or better 26 to 28, ° C. are preferred.

Preferably, any primary coatings sealed with a sealing treatment as described above contain at least 5, or, with increasing preference in the order given, at least 10, 15, 20, or 25 atomic percent in total of metals selected from the group consisting of aluminum, cerium, cobalt, molybdenum, titanium, tungsten, vanadium, zinc, and zirconium, more preferably from the group consisting of aluminum and cobalt. Independently, these primary coatings sealed with a sealing treatment as described above contain at least 5, or, with increasing preference in the order given, at least 10, 15, 20, or 25 atomic percent of oxygen.

After primary coating, intermediate treatments if desired, sealing according to the invention, and drying, a metal substrate is well suited as a base for paint or any similar organic based protective coating, which may be applied in any manner known per se in the art. With the most preferred primary coatings, intermediate treatments, and sealing treatments according to this invention, aluminum substrates often have superior corrosion resistance even without any organic based protective coating.

A sealing composition according to the invention is also well suited for sealing primary coatings formed by treating metal surfaces with compositions and processes as described in any of the following U.S. Patents and copending U.S. Patent Application, all of which, to the extent not inconsistent with any explicit statement herein, are hereby incorporated herein by reference: U.S. Pat. No. 5,089,064 of Feb. 18, 1992 to Reghi; U.S. Pat. No. 5,268,042 of Dec. 7, 1993 to Carlson and U.S. Pat. No. 5,281,282 of Jan. 25, 1994 to Dolan; U.S. Pat. No. 5,342,456 of Aug. 30, 1994 and U.S. Pat. No. 5,356,490 of Oct. 18, 1994 to Dolan et al.; U.S. Pat. No. 5,411,606 of May 2, 1995 and U.S. Pat. No. 5,415,687 of May 16, 1995 to Schriever; U.S. Pat. No. 5,427,632 of Jun. 27, 1995 and U.S. Pat. No. 5,449,414 and U.S. Pat. No. 5,449,415 of Sep. 12, 1995 to Dolan; U.S. Pat. No. 5,472,524 of Dec. 5, 1995 and U.S. Pat. No. 5,487,949 of Jan. 30, 1996 to Schriever; U.S. Pat. No. 5,534,082 of Jul. 9, 1996 to Dollman et al.; U.S. Pat. No. 5,551,994 of Sep. 3, 1996 to Schriever; and International Application No. PCT/US94/13273 designating the U.S. and filed Nov. 23, 1994. Furthermore, even for instances in which the claims of any of these patents and applications may be restricted to coatings formed by drying into place, coatings formed by treatment with the compositions taught therein and subsequent rinsing also are preferred primary coatings for sealing with a sealing composition and process according to this invention.

The invention may be further appreciated by consideration of the following non-limiting working and comparison examples and test results.

A working primary coating composition was prepared as follows: 1063 grams of an aqueous solution of cobalt(II) nitrate containing 13% of cobalt and 670 grams of magnesium acetate tetrahydrate were added to about 15 liters of deionized water. After these ingredients had been thoroughly mixed at ambient temperature, aeration of the liquid mixture was begun; 131 grams of triethanolamine of 99% purity was then added, and after thorough mixing of this ingredient had been accomplished, 168 grams of an aqueous solution of hydrogen peroxide containing 35% $H_2O_2$ was added. This liquid mixture was then diluted to a total volume of 30.3 liters with additional deionized water, to produce a liquid solution that, when diluted to 10 times its initial volume with deionized water, produced a primary coating forming liquid with an absorbance of UV light at 362 nm wavelength, over a 1 cm long transmission path, in the range from 4 to 40%. Heating of the thus diluted liquid solution was begun, and aeration was continued until the temperature of the mixture had been raised to 54±1° C., the selected working temperature, which was maintained during use of this primary coating forming composition as described below.

Rectangular panels of Type 2024-T3 aluminum alloy that were 7.6×25.4 centimeters in size were the substrates used. These substrates were subjected to the following process steps, in which all products identified by the symbol "®" are available from the Henkel Surface Technologies Division of Henkel Corp., Madison Heights, Mich.:

1. Clean by immersion for 5 min at 60° C. in an aqueous solution containing 15 g/L of RIDOLINE® 53 silicate inhibited alkaline cleaner.
2. Rinse with hot water.
3. Deoxidize by immersion for 5 min at 21° C. in an aqueous solution of DEOXIDIZER® 6–16 concentrateprepared as directed by the manufacturer.
4. Rinse with cold water.
5. Immerse in the working primary coating forming composition described next above at the temperature also noted above for 4 to 10 min, depending on the thickness of the primary coating desired.
6. Remove from contact with the working primary coating forming composition and rinse with cold water.
7. immerse for 5 min at 60±1° C. in a sealing composition according to the invention or a comparison thereto as described below.
8. Remove from contact with the sealing composition and rinse with cold water.
9. Dry by blowing with air and/or in an oven at 32 to 66° C.

Sealing Composition 1 according to the invention contained the following ingredients, which were added to about 900 parts of deionized water in the order shown: 4.54 parts of glacial acetic acid; 3.08 parts of lithium hydroxide monohydrate; 1.00 parts of sodium ammonium decavanadate (commercially supplied as SAVAN™ by Kerr-McGee Chemical); CHEMEEN™ C-12 surfactant, commercially supplied by Chemax and reported by its supplier to be 100% PEG-12 cocamine; 3.2 parts of anhydrous potassium fluoride; and sufficient deionized water to bring the total parts to 1000. Sealing Composition 2, not according to the invention, contained the same ingredients as Sealing Composition 1 except that the sodium ammonium decavanadate was omitted. Sealing Composition 3, also not according to the invention, was a solution of 7.5 grams per liter of sodium ammonium decavanadate in deionized water only.

Aluminum panels treated as described above were tested in salt spray at a 6° angle from horizontal, with results reported as the number of pits per panel after at least one particular time of exposure in Table 1 below.

TABLE 1

| Grams of Cobalt per Square Meter of Primary Coating | Sealing Composition Number Used | Pits per Panel after Salt Spray for: 168 Hours | 336 Hours |
|---|---|---|---|
| 0.214 | 1 | none | none |
| 0.243 | 2 | too pitted to count | not measured |
| 0.121 | 3 | 10–25 | not measured |
| 0.122 | 1 | none | none |

It is clear from the results in Table 1 that the corrosion resistance of panels treated according to the invention is far superior to that of panels treated with either comparison composition.

The invention claimed is:

1. A homogeneous liquid composition of matter, comprising water and;

(A') a concentration of at least about 0.0040 M/kg of lithium cations;

(B') a concentration of at least about 0.00050 M/kg of vandium atoms in vanadate anions, said concentration of vanadium atoms in vanadate anions in M/kg having a ratio to said concentration in M/kg of lithium cations that is from about 0.01:1.0 to about 1.0:1.0; and (C') a concentration of fluorine-containing anions that corresponds stoichiometrically to a concentration of fluorine atoms that: (i) is at least about 0.005 M/kg and (ii) has a ratio to said concentration, also measured in M/kg, of lithium cations that is from about 0.20:1.0 to about 10:1.0.

2. A composition according to claim 1, comprising water and;

(A') a concentration of at least about 0.020 M/kg of lithium cations;

(B') a concentration of at least about 0.0030 M/kg of vanadium atoms in vanadate anions, said concentration of vanadium atoms in vanadate anions in M/kg having a ratio to said concentration in M/kg of lithium cations that is from about 0.050:1.0 to about 0.60:1.0;

(C') a concentration of fluorine-containing anions that corresponds stoichiometrically to a concentration of fluorine atoms that: (i) is at least about 0.005 M/kg and (ii) has a ratio to said concentration, also measured in M/kg, of lithium cations that is from about 0.20:1.0 to about 2.0:1.0; and (D') at least 0.00030 ppt of surfactant.

3. A composition according to claim 2, comprising water and;

(A') a concentration of at least about 0.60 M/kg of lithium cations;

(B') a concentration of at least about 0.080 M/kg of vanadium atoms in vanadate anions, said concentration of vanadium atoms in vanadate anions in M/kg having a ratio to said concentration in M/kg of lithium cations that is from about 0.10:1.0 to about 0.18:1.0;

(C') a concentration of fluorine-containing anions that corresponds stoichiometrically to a concentration of fluorine atoms that: (i) is at least about 0.04 M/kg and (ii) has a ratio to said concentration, also measured in M/kg, of lithium cations that is from about 0.55:1.0 to about 1.1:1.0; and (D') at least 0.010 ppt of a component of surfactant molecules that conform to the general formula:

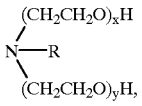

wherein each of x and y represents a non-negative integer and R represents a saturated alkyl moiety hydrophobe group, an average value for the component of surfactant molecules for the sum of x and y being defined as the ratio of the number of oxygen atoms in the component to the number of nitrogen atoms in the component and an average value for the number of carbon atoms in the R moieties being defined as the ratio (c-2o)/n, where c represents the total number of carbon atoms in the component, o represents the total number of oxygen atoms in the component, and n represents the number of nitrogen atoms in the component, said average value for the sum of x and y being from 10 to 14 and for the number of carbon atoms in the R moieties being from 9.0 to 14.0.

4. A homogeneous liquid composition that has been made by dissolving in pure water, or in a liquid that comprises both water and at least one other material that is dissolved, stably dispersed, or both dissolved and stably dispersed therein the following component or components:

(A') an amount of one or more source(s) of lithium cations that contained an amount of lithium cations corresponding to a concentration of at least about 0.0040 M/kg of lithium cations in said composition;

and, unless said amount of the source(s) of lithium cations that were dissolved also supplied to the composition when dissolved a source of vanadate anions in an amount that corresponded to a concentration of vanadium atoms in said composition that: (i) was at least about 0.00050 M/kg and (ii) had a ratio to said concentration in M/kg of lithium cations that was from about 0.01:1.0 to about 1.0:1.0, (B") an amount of the source(s) of vanadate anions that, together with any vanadate anions contained in the source(s) of lithium cations, supplied to said composition a concentration of vanadium atoms that: (i) was at least about 0.0030 M/kg and (ii) had, when measured in M/kg, a ratio to said concentration in M/kg of lithium cations that was from about 0.050:1.0 to about 0.60:1.0;

and, unless the source(s) of lithium cations and of vanadate anions that were dissolved also supplied to the composition when dissolved an amount of fluorine-containing anions that corresponds stoichiometrically to a concentration of fluorine atoms that: (i) was at least about 0.005 M/kg and (ii) had a ratio to said concentration, also measured in M/kg, of lithium cations that was from about 0.20:1.0 to 10:1.0, (C") an amount of a source of fluorine-containing anions that, together with any fluorine-containing anions that were supplied by said source(s) of lithium cations and of vanadate anions, corresponded stoichiometrically to a concentration of fluorine atoms in said composition that: (i) was at least about 0.0050 M/kg and (ii) had a ratio to said concentration, also measured in M/kg, of lithium cations that was from about 0.02:1.0 to about 10:1.0.

5. A composition according to claim 4 wherein, to make the composition, there was dissolved, stably dispersed, or both dissolved and stably dispersed the following component or components:

(A") an amount of the source(s) of lithium cations that contained an amount of lithium cations corresponding to a concentration in the composition of at least about 0.020 M/kg of lithium cations;

and, unless the source(s) of lithium cations that were dissolved also supplied to the composition when dissolved vanadate anions in an amount that corresponded to a concentration of vanadium atoms that: (i) was at least about 0.0030 M/kg and (ii) when measured in M/kg had a ratio to said concentration in M/kg of lithium cations from about 0.050:1.0 to about 0.60:1.0, (B") an amount of the source(s) of vanadate anions that, together with any vanadate anions supplied to the composition by the source(s) of lithium cations, supplied to said composition a concentration of vanadium atoms that: (i) was at least about 0.0030 M/kg and (ii) when measured in M/kg had a ratio to said concentration in M/kg of lithium cations from about 0.050:1.0 to about 0.60:1.0;

and, unless the source(s) of lithium cations and of vanadate anions that were dissolved also supplied to the composition when dissolved an amount of fluorine-containing anions that corresponds stoichiometrically to a concentration of fluorine atoms that: (i) was at least about 0.005 M/kg and (ii) had a ratio to said concentration, also measured in M/kg, of lithium cations that was from about 0.20:1.0 to about 2.0:1.0, (C") an amount of a source of fluorine-containing anions that, together with any fluorine-containing anions that were supplied by the source(s) of lithium cations and of vanadate anions, corresponded stoichiometrically to a concentration of fluorine-containing anions that: (i) was at least about 0.005 M/kg and (ii) had a ratio to said concentration, also measured in M/kg, of lithium cations that was from about 0.20:1.0 to about 2.0:1.0;

and, unless the source(s) of lithium cations, of vanadate anions, and of fluorine-containing anions together supplied to said composition an amount of at least 0.00030 ppt of surfactant, (D") an amount of surfactant that, together with any surfactant that was supplied to said composition by the source(s) of lithium cations, vanadate anions, and fluorine-containing anions, supplied to said composition at least 0.00030 ppt of surfactant.

6. A composition according to claim 5, wherein, to make the composition, there was dissolved the following component or components:

(A") an amount of the source(s) of lithium cations that contained an amount of lithium cations corresponding to a concentration in the composition of at least about 0.60 M/kg of lithium cations;

and, unless the source(s) of lithium cations that were dissolved also supplied to the composition when dissolved a source of decavanadate anions in an amount that corresponded to a concentration of decavanadate anions that: (i) was at least about 0.080 M/kg and (ii) had a ration to said concentration in M/kg of lithium cations that was from about 0.10:1.0 to about 0.18:1.0, (B") an amount of source(s) of decavanadate anions that, together with any decavanadate anions supplied to the composition by the source(s) of lithium cations, supplied to said composition a concentration of decavanadate anions that was: (i) at least about 0.080 M/kg and (ii) had a ratio to the concentration in M/kg of lithium cations in the same composition that was from about 0.10:1.0 to about 0.18:1.0;

and, unless the source(s) of lithium cations and of decavanadate anions that were dissolved also supplied to the composition when dissolved an amount of fluorine-containing anions that corresponded stoichiometrically to a concentration of fluorine atoms that: (i) was at least about 0.40 M/kg and (ii) had a ratio to said concentration, also measured in M/kg, of lithium cations that was from about 0.55:1.0 to about 1.1:1.0, (C") an amount of a source of fluorine-containing anions that, together with any fluorine-containing anions that were supplied by the source(s) of lithium cations and of decavanadate anions, supplied to said composition a concentration of fluorine-containing anions that corresponded stoichiometrically to a concentration of fluorine atoms that: (i) was at least about 0.04 M/kg and (ii) had a ratio to said concentration, also measured in M/kg, of lithium cations that is from about 0.55:1.0 to about 1.1:1.0;

and, unless the source(s) of lithium cations, decavanadate anions, and fluorine-containing anions that were dissolved also supplied to the composition when dissolved at least 0.010 ppt of a component of surfactant molecules that conform to the general formula:

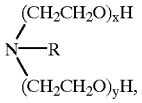

wherein each of x and y represents a non-negative integer and R represents a saturated alkyl moiety hydrophobe group, an average value for the component of surfactant molecules for the sum of x and y being defined as the ratio of the number of oxygen atoms in the component to the number of nitrogen atoms in the component and an average value for the number of carbon atoms in the R moieties being defined as the ratio (c-2o)/n, where c represents the total number of carbon atoms in the component, o represents the total number of oxygen atoms in the component, and n represents the number of nitrogen atoms in the component, said average value for the sum of x and y being from 10 to 14 and for the number of carbon atoms in the R moieties being from 9.0 to 14.0;

(D") a source of at least 0.010 ppt of a surfactant molecules that conform to the general formula:

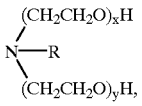

wherein each of x and y represents a non-negative integer and R represents a saturated alkyl moiety hydrophobe group, an average value for the component of surfactant molecules for the sum of x and y being defined as the ratio of the number of oxygen atoms in the component to the number of nitrogen atoms in the component and an average value for the number of carbon atoms in the R moieties being defined as the ratio (c-2o)/n, where c represents the total number of carbon atoms in the component, o represents the total number of oxygen atoms in the component, and n represents the number of nitrogen atoms in the component, said average value for the sum of x and y being from 10 to 14 and for the number of carbon atoms in the R moieties being from 9.0 to 14.0.

7. A process for improving the corrosion resistance of a metal object bearing a primary protective coating over the surface of the metal object, said process comprising a step of contacting said primary protective coating with a composition according to claim 6.

8. A process according to claim 7, wherein said primary protective coating has been formed by treatment of a cleaned metal surface with primary treatment composition made by reaction in an aqueous solution comprising water and the following dissolved components:

(A) cobalt(II) cations;

(B) carboxylate anions;

(C) chemical species, exclusive of carboxylate anions, that form more stable coordination bonds with cobalt (III) cations than with cobalt(II) cations; and (D) oxidizing agent, wherein the ratio of the number of moles of component (B) to the number of moles of component (A) in the aqueous solution prior to reaction was from 0.10 to 6.8.

9. A process according to claim 8, wherein the cleaned metal surface was a surface of aluminum alloy that had been both cleaned and deoxidized, and the primary treatment composition was formed by reaction among the following dissolved components:

(A) a concentration of from about 0.60 to about 0.90 M of cobalt(II) cations;

(B) a concentration of acetate anions that had a ratio to the concentration of cobalt(II) cations, measured in the same units, that was from about 2.3:1.0 to about 3.4:1.0;

(C) a concentration of hydroxyalkyl amines that provided to the primary treatment composition of molar concentration of nitrogen atoms, each having an unshared electron pair, that had a ratio to the molar concentration of cobalt cations that was from about 0.30:1.0 to about 0.50:1.0;

(D) a molar concentration of peroxide moieties that had a ratio to the molar concentration of cobalt atoms that was from about 0.60:1.0 to about 1.0:1.0; and (E) a molar concentration of nitrate ions that had a ratio to the molar concentration of cobalt ions that was from about 1.6 to about 2.4; and, optionally, one or more of the following components:

(F) a component selected from the group consisting of alkali metal and alkaline earth metal cations; and (G) fluoride and complex fluoride anions.

10. A process for improving the corrosion resistance of a metal object bearing a primary protective coating over the surface of the metal object, said process comprising a step of contacting said primary protective coating with a composition according to claim 4.

11. A process according to claim 10, wherein said primary protective coating has been formed by treatment of a cleaned metal surface with a primary treatment composition made by reaction in an aqueous solution comprising water and the following dissolved components:

(A) cobalt(II) cations;

(B) carboxylate anions;

(C) chemical species, exclusive of carboxylate anions, that form more stable coordination bonds with cobalt (III) cations than with cobalt(II) cations; and (D) oxidizing agent, wherein the ratio of the number of moles of component (B) to the number of moles of component (A) in the aqueous solution prior to reaction was from 0.10 to 6.8.

12. A process according to claim 11, wherein the cleaned metal surface was an aluminum alloy surface that had been both cleaned and deoxidized, and the primary treatment composition was formed by reaction among the following dissolved components:

(A) a concentration of from about 0.60 to about 0.90 M of cobalt(II) cations;

(B) a concentration of acetate anions that had a ratio to the concentration of cobalt(II) cations, measured in the same units, that was from about 2.3:1.0 to about 3.4:1.0;

(C) a concentration of hydroxyalkyl amines that provided to the primary treatment composition a molar concentration of nitrogen atoms, each having an unshared electron pair, that had a ratio to the molar concentration of cobalt cations that was from about 0.30:1.0 to about 0.50:1.0;

(D) a molar concentration of peroxide moieties that had a ratio to the molar concentration of cobalt atoms that was from about 0.60:1.0 to about 1.0:1.0; and (E) a molar concentration of nitrate ions that had a ratio to the molar concentration of cobalt ions that is from about 1.6 to about 2.4; and, optionally, one or more of the following components;

(F) a component selected from the group consisting of alkali metal and alkaline earth metal cations; and (G) fluoride and complex fluoride anions.

13. A process for improving the corrosion resistance of a metal object bearing a primary protective coating over the surface of the metal object, said process comprising a step of contacting said primary protective coating with a composition according to claim 3.

14. A process according to claim 13, wherein said primary protective coating has been formed by treatment of a cleaned metal surface with a primary treatment composition made by reaction in an aqueous solution comprising water and the following dissolved components:

(A) cobalt(II) cations;

(B) carboxylate anions;

(C) chemical species, exclusive of carboxylate anions, that form more stable coordination bonds with cobalt (III) cations than with cobalt(II) cations; and (D) oxidizing agent, wherein the ratio of the number of moles of component (B) to the number of moles of component (A) in the aqueous solution prior to reaction was from 0.10 to 6.8.

15. A process according to claim 14, wherein the cleaned metal surface was an aluminum alloy surface that had been both cleaned and deoxidized, and the primary treatment composition was formed by reaction among the following dissolved components:

(A) a concentration of from about 0.60 to about 0.90 M of cobalt(II) cations;

(B) a concentration of acetate anions that had a ratio to the concentration of cobalt(II) cations, measured in the same units, that was from about 2.3:1.0 to about 3.4:1.0;

(C) a concentration of hydroxyalkyl amines that provides to the primary treatment composition a molar concentration of nitrogen atoms, each having an unshared electron pair, that had a ratio to the molar concentration of cobalt cations that was from about 0.30:1.0 to about 0.50:1.0;

(D) a molar concentration of peroxide moieties that had a ratio to the molar concentration of cobalt atoms that was from about 0.60:1.0 to about 1.0:1.0; and (E) a molar concentration of nitrate ions that had a ratio to the molar concentration of cobalt ions that was from about 1.6 to about 2.4; and, optionally, one or more of the following components;

(F) a component selected from the group consisting of alkali metal and alkaline earth metal cations; and (G) fluoride and complex fluoride anions.

16. A process for improving the corrosion resistance of a metal object bearing a primary protective coating over the surface of the metal object, said process comprising a step of contacting said primary protective coating with a composition according to claim 1.

17. A process according to claim 16, wherein said primary protective coating has been formed by treatment of a cleaned metal surface with a primary treatment composition made by reaction in an aqueous solution comprising water and the following dissolved components:

(A) cobalt(II) cations;

(B) carboxylate anions;

(C) chemical species, exclusive of carboxylate anions, that form more stable coordination bonds with cobalt (III) cations than with cobalt(II) cations; and (D) oxidizing agent, wherein the ratio of the number of moles of component (B) to the number of moles of component (A) in the aqueous solution prior to reaction was from 0.10 to 6.8.

18. A process according to claim 17, wherein the cleaned metal surface was an aluminum alloy surface that had been both cleaned and deoxidized, and the primary treatment composition was formed by reaction among the following dissolved components:

(A) a concentration of from about 0.60 to about 0.90 M of cobalt(II) cations;

(B) a concentration of acetate anions that had a ratio to the concentration of cobalt(II) cations, measured in the same units, that was from about 2.3:1.0 to 3.4:1.0;

(C) a concentration of hydroxyalkyl amines that provided to the primary treatment composition a molar concentration of nitrogen atoms, each having an unshared electron pair, that had a ratio to the molar concentration of cobalt cations that was from about 0.30:1.0 to about 0.50:1.0;

(D) a molar concentration of peroxide moieties that had a ratio to the molar concentration of cobalt atoms that was from about 0.60:1.0 to about 1.0:1.0; and (E) a molar concentration of nitrate ions that had a ratio to the molar concentration of cobalt ions that is from about 1.6 to about 2.4; and, optionally, one or more of the following components;

(F) a component selected from the group consisting of alkali metal and alkaline earth metal cations; and (G) fluoride and complex fluoride anions.

19. A method of improving the corrosion resistance of a metal object having a surface, said method comprising:

a) forming a primary protective coating over the surface of the metal object, said primary protective coating being comprised of cobalt, oxygen, and metal atoms from the metal object; and b) contacting said primary protective coating with a homogeneous liquid composition of matter comprising water, lithium cations, and vanadate anions.

20. The method of claim 19 wherein step (a) is accomplished by treating the surface of the metal object with a primary treatment composition made by reaction in an aqueous solution comprising water and the following dissolved components:

(A) cobalt (II) cations;

(B) carboxylate anions;

(C) chemical species, exclusive of carboxylate anions, that form more stable coordination bonds with cobalt (III) cations than with cobalt (II) cations; and (D) oxidizing agent, wherein the ratio of the number of moles of component (B) to the number of moles of component (A) in the aqueous solution prior to treatment of the surface of the metal object was from 0.10 to 6.8.

* * * * *

UNITED STATES PATENT AND TRADEMARK OFFICE

CERTIFICATE OF CORRECTION

PATENT NO. : 6,315,823 B1
DATED : November 13, 2001
INVENTOR(S) : Shawn E. Dolan It is certified that error appears in the above-identified patent and that said Letters Patent is hereby corrected as shown below:

Title page,
Item [60], after "PCT Pub. Date: Nov. 19, 1998", on a new line, insert the following:
-- Related U.S. Application Data
[60] Provisional application No. 60/046,682, filed on May 16, 1997. --

Column 13,
Line 18, after "water and", delete ";" and insert therefor -- : --.
Line 31, delete "0.20:1.0", and insert therefor -- 0.02:1.0 --.
Lines 34 and 51, after "and", delete ";" and insert therefor -- : --.

Column 14,
Line 26, delete "(A')", and insert therefor -- (A") --.
Line 50, delete "0.20:1.0", and insert therefor -- 0.02:1.0 --.
Line 56, "0.0050", and insert therefor -- 0.005 --.

Column 15,
Line 53, delete "ration", and insert therefor -- ratio --.
Line 56, after "amount of", insert -- the --.

Column 16,
Line 2, delete "0.40", and insert therefor -- 0.04 --.

Column 17,
Line 3, after "surface with", insert -- a --.
Line 28, after "composition", delete "of" and insert therefor -- a --.

Column 18,
Lines 20 and 67, after "components", delete ";", and insert therefor -- : --.

UNITED STATES PATENT AND TRADEMARK OFFICE

CERTIFICATE OF CORRECTION

PATENT NO. : 6,315,823 B1
DATED : November 13, 2001
INVENTOR(S) : Shawn E. Dolan It is certified that error appears in the above-identified patent and that said Letters Patent is hereby corrected as shown below:

Column 20,
Line 7, after "components", delete ";", and insert therefor -- : --.

Signed and Sealed this

Ninth Day of September, 2003

JAMES E. ROGAN
*Director of the United States Patent and Trademark Office*